264624

United States Patent [19]

Bonner

[11] Patent Number: 4,924,736

[45] Date of Patent: May 15, 1990

[54] GRIPPING SCREW DRIVE BIT

[75] Inventor: Ben V. Bonner, Bloomfield Hills, Mich.

[73] Assignee: A.T. & G Company, Inc., Farmington Hills, Mich.

[21] Appl. No.: 347,059

[22] Filed: May 4, 1989

[51] Int. Cl.[5] ..... B25B 23/08

[52] U.S. Cl. ..... 81/448; 81/452

[58] Field of Search ..... 81/454, 452, 436, 448, 81/439

[56] References Cited

FOREIGN PATENT DOCUMENTS 0403091 2/1967 Australia ..... 81/448

0780100 7/1957 United Kingdom ..... 81/448

*Primary Examiner*—Frederick R. Schmidt
*Assistant Examiner*—Lawrence Cruz
*Attorney, Agent, or Firm*—Robert G. Mentag

[57] ABSTRACT

A gripping screw drive bit for use with conventional drive sockets which utilize non-magnetic means for gripping and retaining Robertson, TORX, and hexagonal screws and bolts. The gripping bit comprises two mating members. The gripping action is provided by the misalignment of the two members of a composite gripping bit, within a screw head recess, when a minimal amount of torque is exerted upon the composite gripping bit by a drive socket.

4 Claims, 3 Drawing Sheets

GRIPPING SCREW DRIVE BIT

BACKGROUND OF THE INVENTION

1. Technical Field

The present invention generally relates to a drive bit for driving a screw or bolt. More specifically, this invention relates to a drive bit suitable for gripping a screw or bolt through non-magnetic means. Class 81, Subclass 436, Screw Driver Implement, U.S. Patent Office Classification, appears to be the applicable general area of art to which the subject matter similar to this invention has been classified in the past.

2. Background Information

Drive bits are extensively used with socket drives for driving threaded screws and bolts. The simple interchangeability of the drive bits lends their use to a large variety of screw and bolt forms and sizes. However, a shortcoming with drive bits, as with all forms of screw drivers, is their inability to firmly retain the screw on the end of the bit. This is a desirable feature when the location that the screw is to be installed precludes the use of the user's hands or other means for holding the screw until the screw threads have sufficiently engaged the receiving body. One solution has been to use a magnetized drive bit to provide retention between the drive bit and screw. However, the use of a magnetized drive bit is also at times precluded when working around magnetic-sensitive equipment or hen driving non-magnetic screws such as those formed from aluminum.

There have been devices proposed for non-magnetically retaining conventional slotted screws through the use of drivers that grip the slotted screw head recess. An example of this type of retention means is U.S. Pat. No. 3,224,479 to Osborn et al. However, the Osborn device lends itself to the retention of slotted screws only and does not address many other types of screw head recess forms in use today. Examples of significance to the present invention are the Robertson, the TORX, and the hexagonal types of screw head recess forms. The three forms presented here are all characterized by relatively large screw head recesses as viewed from the screw's longitudinal axis. The Robertson form is substantially that of a square. The TORX form is substantially hexagonal with arcuate smoothly contoured concave sides and convex points. The hexagonal form takes its name literally from its geometric shape. Because of the dissimilar and unique screw head recess forms of each, the non-magnetic retention means offered by the current state of the art is impractical. Therefore, what is needed is a drive bit having non-magnetic retention means for screw head recess forms such as the Robertson, TORX, and hexagonal that can effectively and firmly grip the screw until sufficiently engaged in the receiving body.

SUMMARY OF THE INVENTION

It is an object of the present invention to provide a drive bit with means for retaining Robertson, TORX, and hexagonal screws.

It is a further object of this invention that such drive bit provide non-magnetic retention means for use around magnetic-sensitive equipment and for use with non-magnetic screw materials, such as aluminum.

Lastly, it is an object of this invention to provide a drive bit comprised of two members whose retention means is a gripping action that is derived from the relative motion between the two members while engaged within the screw head recess.

In accordance with the preferred embodiment of this invention, these and other objects and advantages are accomplished as follows.

According to the present invention there is provided a gripping drive bit which is adapted for use with a Robertson, TORX, or hexagonal screw. The drive bit comprises two members. The first member is substantially elongated in shape and has a driving end, an oppositely disposed driven end, and a substantially planar surface that runs it longitudinal length. The second member is also substantially elongated in shape and correspondingly has a driving end, a driven end, and a substantially planar surface that runs its longitudinal length. The first and second members are complementary and mate along their planar surfaces so that their respective driving ends and driven ends mate accordingly to form composite driving and driven ends, respectively. The composite driving end is of proper form and size for engaging a conventional Robertson, TORX, or hexagonal screw head recess. The composite driven end, located opposite to the driving end, is of such form to engage a conventional socket drive, preferably a hexagonal socket drive. Notches for receiving the retaining ring of a socket drive so equipped are provided substantially adjacent to the composite driven end. The planar surfaces of the two members are defined by a longitudinal plane which is at an acute angle with the rotational axis or longitudinal center line of the composite bit, and which also passes through the approximate center of the composite driving end. The longitudinal plane also forms a second acute angle, with a diametral center line or straight line passing from side to side of the composite driving end through said rotational axis, that bisects a driving point or lobe of the particular screw head recess form.

According to a preferred aspect of this invention, the means for retaining the screw or bolt on the driving end of the drive bit is provided when the composite driving end becomes misaligned after a minimal amount of torque has been exerted on the screw by the drive bit. The misalignment is created when the two mating members of the composite drive bit forcibly slip along their respective planar surfaces as a result of the applied torque. The individual driving ends of the bit members are forced along the grades provided by the acute angles of the longitudinal plane, each driving end being forced in opposing diagonal directions of the particular screw head recess form. This action effectively provides for securely gripping a Robertson, TORX, or hexagonal screw or bolt under most practical conditions without the need for a magnetized drive bit.

A significant advantage of the disclosed invention is the non-magnetic means for retaining screws on the driving end of the drive bit, allowing the driver to be used with non-magnetic screws or in environments that are sensitive to magnets and their accompanying magnetic fields. Another advantage is that the drive bit can be used with a conventional socket drive and is specifically formed to drive a Robertson, TORX, or hexagonal screw or bolt, each type having a unique screw head retention form.

Other objects and advantages of this invention will be better appreciated after a detailed description thereof which follows.

DESCRIPTION OF THE PREFERRED EMBODIMENTS

Figure 1:
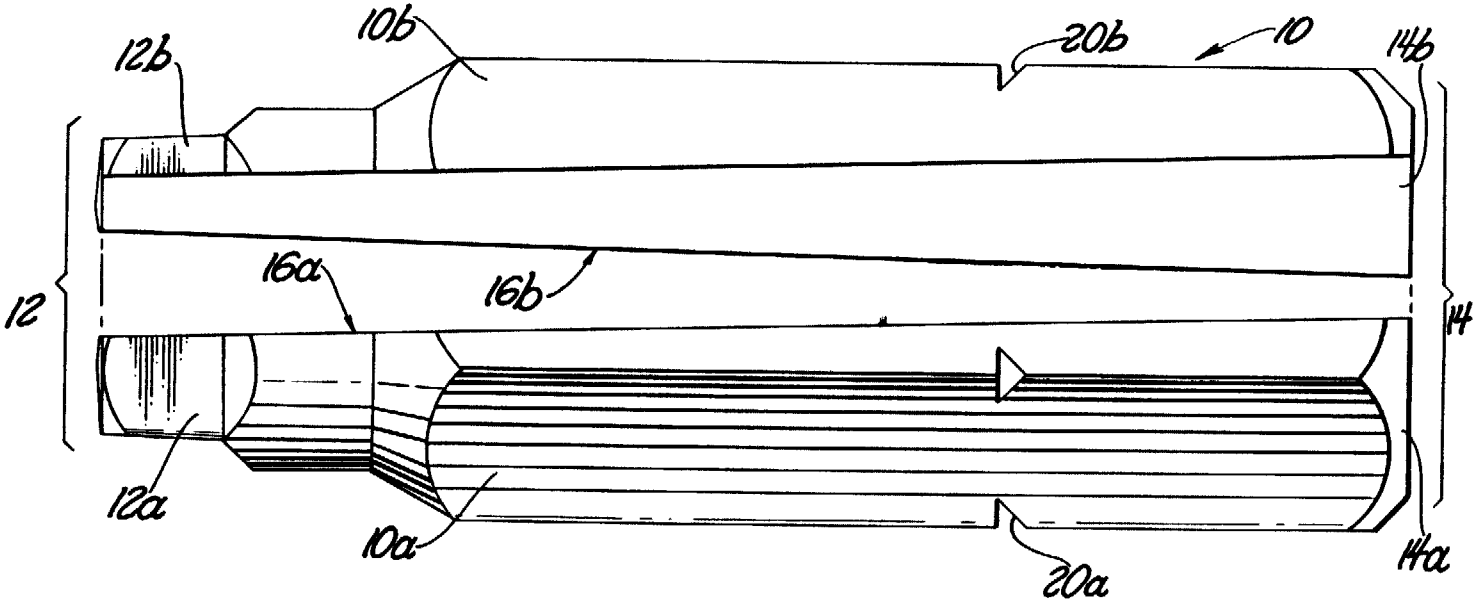
FIG. 1 is an exploded view of a composite gripping drive bit for use with a Robertson screw or bolt in accordance with a preferred embodiment of this invention.

In a preferred embodiment of this invention, the composite gripping screw drive bit 10, as shown in FIG. 1, comprises two members, 10*a* and 10*b*. Each member comprises a driven end, 14*a* and 14*b*, disposed at one end of the member, an oppositely disposed driving end 12*a* and 12*b*, and a substantially planar surface 16*a* and 16*b* that runs each member's longitudinal length interposed between driven ends 14*a* and 14*b* and driving ends 12*a* and 12*b*. The first and second members 10*a* and 10*b* are complementary and mate along their planar surfaces 16*a* and 16*b* so that their respective driving ends 12*a* and 12*b* and driven ends 14*a* and 14*b* mate accordingly to form composite driving end 12 and composite driven end 14, respectively.

Planar surfaces 16*a* and 16*b* are defined by a longitudinal plane 18 which is at an acute angle with the longitudinal center line of the composite gripping screw drive bit 10, and which also passes through the approximate center of the composite driving end 12. Because the planar surfaces 16*a* and 16*b* preferably pass through the composite driven end 14, the maximum for this acute angle is limited by the length and diameter of the composite gripping screw drive bit 10. The angle must be greater than zero degrees to enhance the motive force between members 10*a* and 10*b*, but preferably less than approximately 10 degrees.

Where longitudinal plane 18 passes through the approximate center of composite driving end 12, a second acute angle is formed with a diametral center line that bisects a driving feature of the composite driving end 12. Drive features are defined for purposes of the present invention as the projections on the composite driving end 12 which correspond to the projected internal features of the screw head recess of the screw or bolt, and that provide the physical contact for the transfer of rotational motion and torque between the composite driving end 12 and the screw head recess. The second acute angle has a preferred angular range of greater than about 5 degrees but less than about 40 degrees. There is no specifically preferred angle since the relative slippage between the driving ends 12*a* and 12*b* requires only that the longitudinal plane 18 does not bisect a driving feature of composite driving end 12. The second acute angle must be of sufficient magnitude to promote relative slippage between the driving ends 12*a* and 12*b*, but at the same time it is limited by the angular positions of the drive features of the particular drive form. The composite gripping screw drive bit members 10*a* and 10*b* are unsymmetrical as a result of their planar surfaces being defined by the first and second acute angles.

Disposed around circumference of the composite gripping screw drive bit 10 there may be retaining notches 20*a* and 20*b* for engaging the retaining ring of a socket drive so equipped. The retaining notches are substantially adjacent to the driven end and assist in retaining the composite gripping screw drive bit within a socket drive during use. Alternatively, composite gripping screw drive bit 10 may be retained magnetically within a socket drive if the gripping screw drive bit 10 is formed from an appropriate magnetic material.

Figure 2:
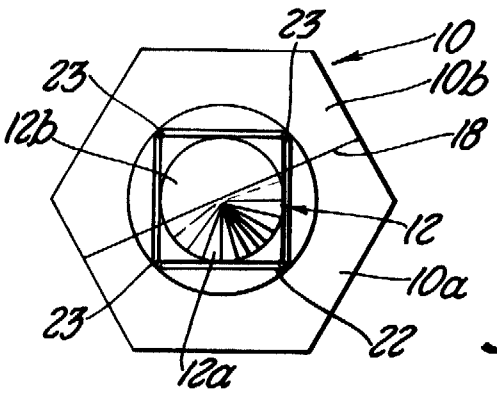
FIG. 2 is an end view of the driving end of the composite gripping drive bit for use with a Robertson screw or bolt as shown in FIG. 1.

In FIG. 2 an end view of the driving end 12 of composite gripping screw drive bit 10 illustrates the Robertson form 22 for use with a Robertson screw or bolt and depicts a drive feature 23 for Robertson drive form 22 as being a corner of the substantially square Robertson drive form 22. The Robertson drive form 22 therefore has four drive features 23 corresponding to the four projections of the square Robertson form 22. The number of drive features corresponds to the particular drive form of the composite gripping screw drive bit 10.

The composite driven end 14 is illustrated throughout the Figures as being of hexagonal form for engaging a conventional hexagonal socket drive. It is well known in the art that there is a wide range of socket drive forms and sizes available. It can readily be seen that the composite driven end 14 of the present invention can be of any such form as to engage the various socket drive forms available and therefore is not limited to the hexagonal form illustrated.

Figure 3:
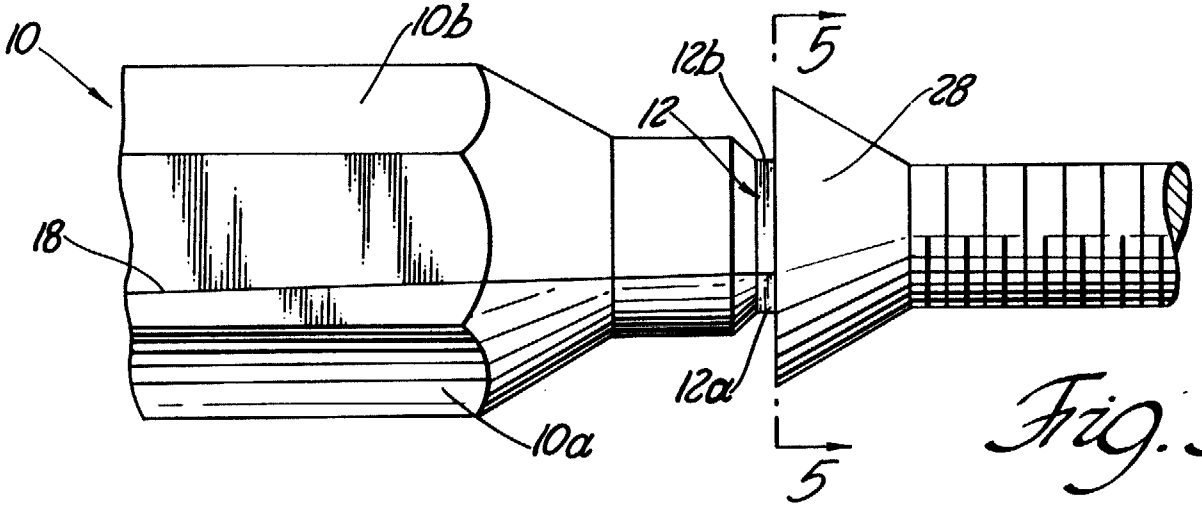
FIG. 3 is a partial side view of a composite gripping drive bit engaged with a Robertson screw in accordance with a preferred embodiment of this invention.

FIG. 3 illustrates the engagement of the composite driving end 12 of the composite gripping screw bit 10 with the screw head recess of a conventional screw 28 having an appropriate screw head recess, such as Robertson, TORX, or hexagonal type.

Figure 4:
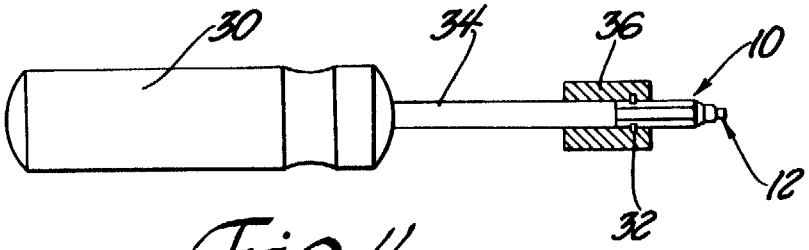
FIG. 4 is a side view of a composite gripping drive bit in accordance with a preferred embodiment of this invention which is installed in a conventional screw driver with a hexagonal socket.

FIG. 4 illustrates the engagement of the composite gripping screw drive bit with a conventional hexagonal socket drive 36 for illustrative purposes only. The hexagonal socket drive 36 is mounted on the end of the drive shank 34 of a conventional screw driver handle 30. A retaining ring 32 is illustrated as being disposed within the hexagonal socket drive 36 and engaged with the retaining notches 20 of composite gripping screw drive bit 10. When the user engages the composite driving end 12 with a screw head recess, as shown in FIG. 3, and applies sufficient rotational torque through handle 30, misalignment of the composite driving end 12 occurs through the interaction of the drive bit members 10*a* and 10*b* along their planar surfaces 16*a* and 16*b*.

Figure 5:
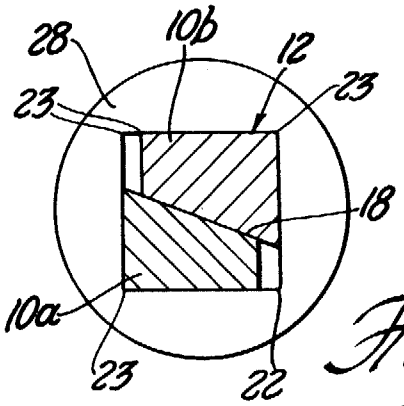
FIG. 5 is a cross sectional view of the composite gripping drive bit for use with a Robertson screw as shown in FIG. 3 illustrating the relationship of the individual driving ends of the two members when engaged with and gripping the screw head recess of a Robertson screw.

FIG. 5 illustrates the result of the composite driving end 12 misalignment within a screw head recess having the Robertson form 22. The means for retaining the screw 28 on the composite driving end 12 of the composite gripping screw drive bit 10 is provided when the member driving ends 12*a* and 12*b* become misaligned after a minimal amount of torque has been exerted. The misalignment is created when the two mating members 10*a* and 10*b* of the composite gripping screw drive bit 10 forcibly slip along their respective planar surfaces 16*a* and 16*b* as a result of the applied torque. The individual driving ends 12*a* and 12*b* of the bit members 10*a* and 10*b* are forced along the grades provided by the first and second acute angles of the longitudinal plane 18, each driving end 12*a* and 12*b* being forced in opposing diagonal directions within the Robertson screw head recess form 22, from their positions shown in FIG. 2 to their positions shown in FIG. 5. That is, the driving ends 12*a* and 12*b* are forced outward in two directions from their initial positions in FIG. 3 into their gripping positions, shown in FIG. 5, against the adjacent wall surface of the screw head recess form 22. This action effectively provides for securely gripping the Robertson screw 28 without the need for a nagnetixed drive bit.

Figure 6:
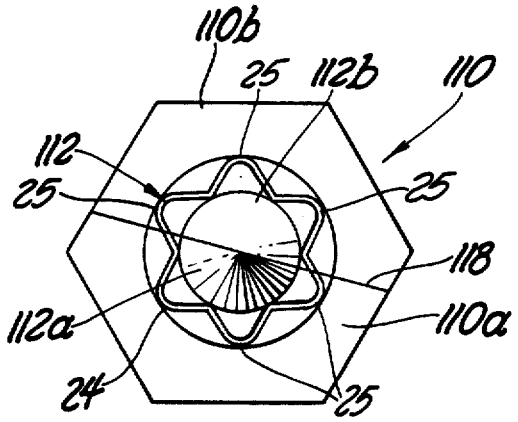
FIG. 6 is an end view of the driving end of a composite drive bit for use with a TORX screw or bolt.

In FIG. 6 an end view of the mated driving ends 112*a* and 112*b* defined by longitudinal plane 118 of an alternative, but equally preferred, composite gripping bit 110 is illustrated of the TORX drive form 24 for use with a TORX screw or bolt. The TORX drive form 24 is substantially hexagonal with arcuate smoothly contoured concave sides and convex points. Drive feature 25 for a TORX drive form 24 is depicted as being a projection of the substantially hexagonal TORX drive form 24. The TORX drive form 24 accordingly has six drive features corresponding to the six projections. Longitudinal plane 118 does not bisect a drive feature 25 of the TORX drive form 24, thus providing a nonsymmetrical mating of the member driving ends 112*a* and 112*b*.

Figure 7:
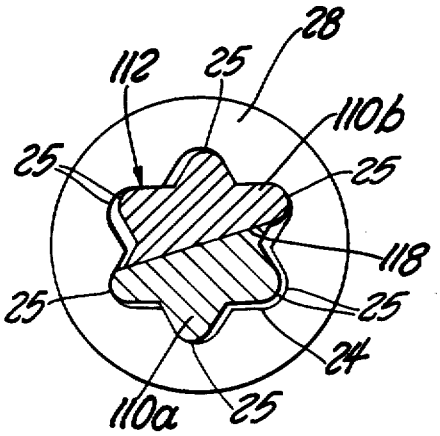
FIG. 7 is a cross sectional view of a composite gripping drive bit for use with a TORX screw showing the relationship of the individual driving ends of the two members when engaged with and gripping the screw head recess of a TORX screw.

FIG. 7 illustrates the misalignment of member driving ends 112*a* and 112*b* within a screw head recess having the TORX drive form 24. The means for retaining the screw 28 on the composite driving end 112 of the composite gripping bit 110 is fundamentally the same as for the Robertson form. Members 110*a* and 110*b* are provided which mate along a longitudinal planar surface defined similarly by a first and second acute angle. The member driving ends 112*a* and 112*b* of the individual bit members 110*a* and 110*b* are forced along the grades provided by the acute angles of the longitudinal plane 118, each driving end 112*a* and 112*b* being forced in opposing diagonal directions within the TORX screw head recess form 24. This action effectively provides for securely gripping the screw 28 under most practical conditions without the need for a magnetized drive bit.

Figure 8:
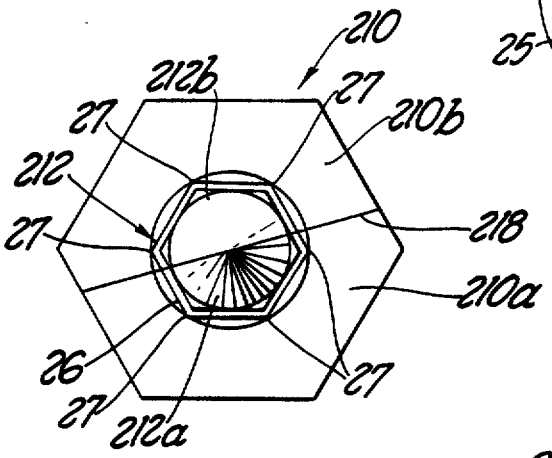
FIG. 8 is an end view of the driving end of a composite gripping drive bit for use with a hexagonal screw or bolt.

FIG. 8 illustrates another alternative, yet preferred embodiment, for use with a hexagonal screw head recess. An end view of mated driving ends 212*a* and 212*b* which are defined by longitudinal plane 218 of composite gripping bit 210 illustrates the hexagonal drive form 26 for use with a hexagonal screw or bolt and depicts a drive feature 27 for a hexagonal drive form 26 as being a projection of the substantially hexagonal drive form 26. The hexagonal drive form 26, accordingly, has six drive features 27 correspondingly to the six projections. Longitudinal plane 218 does not bisect a drive feature 27 of the hexagonal drive form 26, thus providing a nonsymmetrical mating of the member driving ends 212*a* and 212*b*.

Figure 9:
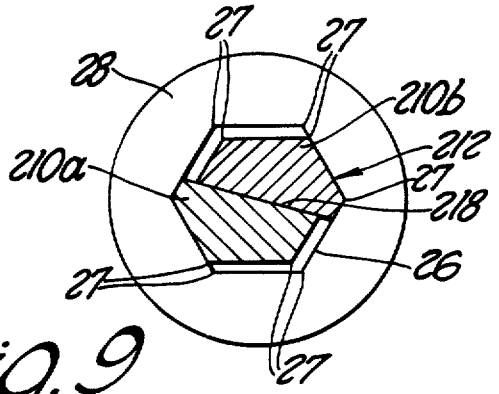
FIG. 9 is a cross sectional view of a composite gripping drive bit for use with a hexagonal screw showing the relationship of the individual driving ends of the two members when engaged with and gripping the screw head recess of a hexagonal screw.

FIG. 9 illustrates the misalignment of member driving ends 212*a* and 212*b* within a screw head recess having the hexagonal drive form 26. The means for retaining the screw 28 on the composite driving end 212 of the composite gripping bit 210 is fundamentally the same as for the Robertson and TORX forms. The member driving ends 212*a* and 212*b* of the bit members 210*a* and 210*b* are forced along the grades provided by the acute angles of the longitudinal plane 218, each driving end 212*a* and 212*b* being forced in opposing diagonal directions within the hexagonal screw head recess form 26. This action effectively provides for securely gripping the screw 28 under most practical conditions without the need for a magnetized drive bit.

In the preferred embodiment, a significant advantage of composite gripping screw drive bit 10 is the nonmagnetic means for retaining screws on the composite driving end 12, allowing its use with non-magnetic screws or in environments that are sensitive to magnets and their accompanying magnetic fields. Another advantage is that the composite gripping screw drive bit 10 can be used with a conventional socket drive, such as hexagonal socket drive 36, and is specifically formed to drive screws or bolts having a screw head recess with the shape of a Robertson form 22, a TORX form 24, or a hexagonal form 28.

While the invention has been described in terms of a preferred embodiment, it is apparent that other forms could be adopted by one skilled in the art. Accordingly, the scope of the invention is to be limited only by the following claims.

What is claimed is:

1. A gripping screw drive bit comprising:

(a) a first drive bit member substantially elongated in shape and having a first driving end, an oppositely disposed first driven end, and a first substantially planar surface that runs the longitudinal length of said first drive bit member interposed between said first driving end and said first driven end;

(b) a second drive bit member substantially elongated in shape and having a second driving end, an oppositely disposed second driven end, and a second substantially planar surface that runs the longitudinal length of said second drive bit member interposed between said second driving end and said second driven end;

(c) said first and second drive bit members being complementary and mating along said first and second planar surfaces so that said first and second driving ends and said first and second driven ends mate to form a composite gripping drive bit having a composite driving end and a composite driven end, respectively; and, (d) said first and second planar surfaces being defined by a longitudinal plane which is disposed at a first predetermined longitudinal acute angle from the rotational axis of the composite gripping drive bit and which passes through the approximate center of said composite driving end and angles longitudinally and radially outward, from the composite driving end to the composite driven end, and said longitudinal plane is also disposed at the composite driving end at a second predetermined acute angle from a straight line, passing from side to side of the composite driving end through said rotational axis on a plane perpendicular to said rotational axis and which would normally divide the composite driving end into a pair of similarly disposed drive features, to bisect the composite driving end into a pair of oppositely disposed drive features of said composite driving end, said composite driving end being adapted to engage a screw head recess in a screw, and said composite driven end being adapted to be engaged by a socket drive, whereby, when a torque is exerted on the gripping screw drive bit, the first and second driving ends are forced outward laterally, in opposing diagonal directions along said longitudinal plane into a gripping engagement with the adjacent wall surface of the screw head recess.

2. A gripping screw drive bit as defined in claim 1, wherein:

(a) said composite driving end has a square form for engaging a similarly shaped screw head recess, and said composite driven end is engagable with a socket drive.

3. A gripping screw drive bit as defined in claim 1, wherein:

(a) said composite driving end has a hexagonal form for engaging a similarly shaped screw head recess, and said composite driven end is engagable with a socket drive.

4. A gripping screw drive bit comprising:

(a) a first drive bit member substantially elongated in shape and having a first driving end, an oppositely disposed first driven end, and a first substantially planar surface that runs the longitudinal length of said first drive bit member interposed between said first driving end and said first driven end;

(b) a second drive bit member substantially elongated in shape and having a second driving end, an oppositely disposed second driven end, and a second substantially planar surface that runs the longitudinal length of said second drive bit member interposed between said second driving end and said second driven end;

(c) said first and second drive bit members being complementary and mating along said first and second planar surfaces so that said first and second driving ends and said first and second driven ends mate to form a composite gripping drive bit having a composite driving end and a composite driven end, respectively;

(d) said first and second planar surfaces being defined by a longitudinal plane which is at a first predetermined acute angle from the longitudinal center line of the composite gripping drive bit, said longitudinal plane passing through the approximate center of said composite driving end, and a second predetermined acute angle from a diametral center line which bisects a pair of oppositely disposed drive features of said composite driving end, said composite driving end being adapted to engage a screw head recess in a screw, and said composite driven end being adapted to be engaged by a socket drive, whereby, when a torque is exerted on the gripping screw drive bit, the first and second driving ends are forced in opposing diagonal directions along said longitudinal plane into a gripping engagement with the adjacent wall surface of the screw head recess; and, (e) said composite driving end has a substantially hexagonal form with arcuate smoothly contoured concave sides and convex points for engaging a similarly shaped screw head recess, and said composite driven end is engagable with a socket drive.

* * * * *